US010368707B2

(12) United States Patent
Lutz et al.

(10) Patent No.: US 10,368,707 B2
(45) Date of Patent: Aug. 6, 2019

(54) ADJUSTABLE VACUUM TUBE CLAMP ASSEMBLY AND VACUUM CLEANERS INCLUDING SAME

(71) Applicant: Emerson Electric Co., St. Louis, MO (US)

(72) Inventors: Christopher Lutz, Wentzville, MO (US); Jason Hill, St. Louis, MO (US); Matthew A. Williams, Bridgeton, MO (US); Nicholas James Cooley, Knoxville, TN (US); Douglas C. Schultz, Glen Carbon, IL (US); Jeremy Sanders, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 28 days.

(21) Appl. No.: 15/447,700

(22) Filed: Mar. 2, 2017

(65) Prior Publication Data

US 2017/0251895 A1 Sep. 7, 2017

Related U.S. Application Data

(60) Provisional application No. 62/303,179, filed on Mar. 3, 2016.

(51) Int. Cl.
*A47L 9/24* (2006.01)
*A47L 9/28* (2006.01)
(Continued)

(52) U.S. Cl.
CPC ..... *A47L 9/244* (2013.01); *A47L 5/28* (2013.01); *A47L 5/36* (2013.01); *A47L 5/362* (2013.01);
(Continued)

(58) Field of Classification Search
CPC . A47L 9/244; A47L 5/28; A47L 5/362; A47L 7/0004; A47L 9/246; A47L 9/2842; A47L 9/2857; A47L 9/9327
See application file for complete search history.

(56) References Cited

U.S. PATENT DOCUMENTS

D209,573 S 12/1967 Leinfelt et al.
D264,011 S 4/1982 Genoa
(Continued)

OTHER PUBLICATIONS

U.S. Appl. No. 29/568,409, filed Jun. 17, 2016, 13 pages.

*Primary Examiner* — Dung Van Nguyen
(74) *Attorney, Agent, or Firm* — Armstrong Teasdale LLP

(57) ABSTRACT

A vacuum cleaner tube assembly includes an outer tube defining a vacuum passage extending from a first end to a second end and an inner tube disposed at least partially within the vacuum passage and connected to the outer tube for telescopic adjustment. The inner tube includes a first end and a second end distal from the first end. The vacuum tube assembly further includes an adjustment clamp connected to the second end of the outer tube. The adjustment clamp includes a clamp body with an inner diameter connected to the second end of the outer tube. The adjustment clamp also includes a lever connected to the clamp body and moveable between a first, latched position and a second, unlatched position to permit selective adjustment of the inner diameter of the clamp body and selective clamping between the clamp body and the inner tube.

20 Claims, 18 Drawing Sheets

(51) Int. Cl.

| | |
|---|---|
| ***A47L 5/28*** | (2006.01) |
| ***A47L 9/32*** | (2006.01) |
| ***A47L 5/36*** | (2006.01) |
| ***A47L 7/00*** | (2006.01) |

(52) U.S. Cl.
CPC ..... *A47L 7/0004* (2013.01); *A47L 9/246* (2013.01); *A47L 9/2842* (2013.01); *A47L 9/2857* (2013.01); *A47L 9/327* (2013.01)

(56) References Cited

U.S. PATENT DOCUMENTS

| | | | | |
|---|---|---|---|---|
| 4,355,922 | A | 10/1982 | Sato | |
| D275,333 | S | 8/1984 | Williams et al. | |
| 4,736,921 | A | 4/1988 | Zane et al. | |
| D314,848 | S | 2/1991 | Foldes | |
| 4,997,154 | A | 3/1991 | Little | |
| 5,170,973 | A | 12/1992 | Ohta | |
| 5,308,032 | A | 5/1994 | Ohta | |
| 5,344,115 | A | 9/1994 | Mayne et al. | |
| 5,478,041 | A | 12/1995 | Mayne | |
| 5,664,904 | A | 9/1997 | Hapgood et al. | |
| 5,702,082 | A | 12/1997 | Evans et al. | |
| 5,836,559 | A | 11/1998 | Ronci | |
| 5,897,087 | A | 4/1999 | Farley | |
| D414,405 | S | 9/1999 | Tompkins | |
| 5,984,248 | A | 11/1999 | Evans et al. | |
| 6,017,008 | A | 1/2000 | Farley | |
| 6,142,699 | A * | 11/2000 | Pao | F16B 7/1454 403/109.5 |
| 6,568,644 | B2 | 5/2003 | Pedersen | |
| 6,648,286 | B1 | 11/2003 | Evans et al. | |
| 6,793,186 | B2 | 9/2004 | Pedersen | |
| D532,947 | S | 11/2006 | Muscarella | |
| 7,244,070 | B2 | 7/2007 | Burnett et al. | |
| 7,287,300 | B2 * | 10/2007 | Rupp | A47L 5/36 15/327.5 |
| D584,604 | S | 1/2009 | Baldwin | |
| D597,715 | S | 8/2009 | Barker | |
| D610,760 | S | 2/2010 | Zugen et al. | |
| 8,006,711 | B2 * | 8/2011 | Pietrzak | A45B 9/00 135/65 |
| 8,132,764 | B2 | 3/2012 | Kuipers | |
| D661,981 | S | 6/2012 | Melino et al. | |
| D664,839 | S | 8/2012 | Bonhag et al. | |
| 8,408,507 | B2 | 4/2013 | Liu | |
| 8,496,018 | B2 | 7/2013 | Lenhart et al. | |
| 8,528,870 | B2 | 9/2013 | Liu et al. | |
| 8,608,118 | B2 * | 12/2013 | Lai | F16B 7/1454 248/74.1 |
| D712,730 | S | 9/2014 | Gridley | |
| 8,979,050 | B2 | 3/2015 | Yu | |
| 9,021,661 | B2 * | 5/2015 | Andel | G01V 3/15 16/429 |
| 9,482,254 | B2 * | 11/2016 | Lai | F16B 7/1418 |
| 9,651,073 | B2 * | 5/2017 | Bukovitz | F16B 7/1454 |
| 2002/0030146 | A1 * | 3/2002 | Akaike | F16M 11/32 248/157 |
| 2010/0072740 | A1 * | 3/2010 | Cordes | A47L 9/244 285/7 |

* cited by examiner

ADJUSTABLE VACUUM TUBE CLAMP ASSEMBLY AND VACUUM CLEANERS INCLUDING SAME

CROSS-REFERENCE TO RELATED APPLICATIONS

This application claims priority to U.S. Provisional Patent Application Ser. No. 62/303,179, filed Mar. 3, 2016, the disclosure of which is hereby incorporated by reference in its entirety.

FIELD

The field relates generally to vacuum cleaning systems, and more particularly, to adjustable vacuum tube clamp assemblies for use with vacuum cleaning systems.

BACKGROUND

Vacuum cleaners generally include a suction unit, a vacuum cleaner floor tool for engaging a surface for cleaning, and a vacuum cleaner tube assembly for directing the vacuum cleaner floor tool and providing suction to the floor tool. The floor tool is connected to a distal end of the vacuum cleaner tube assembly, and a user may direct the vacuum cleaner tube assembly to the surface to be cleaned such that the vacuum cleaner floor tool engages and cleans the surface.

Some vacuum cleaner tube assemblies include adjustment mechanisms that permit selective adjustment of the length of the tube assembly, for example, to accommodate users of different heights or to enable cleaning of hard to reach areas. However, known adjustment mechanisms do not provide satisfactory or adequate adjustment.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum tube assembly includes an outer tube, an inner tube, and an adjustment clamp. The outer tube includes a first end and a second end distal from the first end, and defines a vacuum passage extending from the first end to the second end. The inner tube is disposed at least partially within the vacuum passage, and is connected to the outer tube for telescopic adjustment therewith. The inner tube includes a first end and a second end distal from the first end. One of the first end of the outer tube and the second end of the inner tube is configured for connection to a hose of the vacuum cleaner, and the other of the first end of the outer tube and the second end of the inner tube is configured for connection to a vacuum cleaner tool. The adjustment clamp is connected to the second end of the outer tube. The adjustment clamp includes a clamp body connected to the second end of the outer tube, and a lever operatively connected to the clamp body. The clamp body includes an inner diameter, and the lever is moveable between a first, latched position and a second, unlatched position to permit selective adjustment of the inner diameter of the clamp body and selective clamping between the clamp body and the inner tube.

In another aspect, a vacuum cleaner includes a vacuum cleaner suction unit and a vacuum tube assembly. The vacuum tube assembly is connected in fluid communication with the vacuum cleaner suction unit. The vacuum tube assembly includes an outer tube, an inner tube, and an adjustment clamp. The outer tube includes a first end and a second end distal from the first end, and defines a vacuum passage extending from the first end to the second end. The inner tube is disposed at least partially within the vacuum passage, and is connected to the outer tube for telescopic adjustment therewith. The inner tube includes a first end and a second end distal from the first end. One of the first end of the outer tube and the second end of the inner tube is configured for connection to a hose of the vacuum cleaner, and the other of the first end of the outer tube and the second end of the inner tube is configured for connection to a vacuum cleaner tool. The adjustment clamp is connected to the second end of the outer tube. The adjustment clamp includes a clamp body connected to the second end of the outer tube, and a lever operatively connected to the clamp body. The clamp body includes an inner diameter, and the lever is moveable between a first, latched position and a second, unlatched position to permit selective adjustment of the inner diameter of the clamp body and selective clamping between the clamp body and the inner tube.

In yet another aspect, a backpack vacuum cleaner includes a backpack assembly and a vacuum tube assembly. The backpack assembly includes a vacuum cleaner suction unit. The vacuum tube assembly is connected in fluid communication with the vacuum cleaner suction unit. The vacuum tube assembly includes an outer tube, an inner tube, and an adjustment clamp. The outer tube includes a first end and a second end distal from the first end, and defines a vacuum passage extending from the first end to the second end. The inner tube is disposed at least partially within the vacuum passage, and is connected to the outer tube for telescopic adjustment therewith. The inner tube includes a first end and a second end distal from the first end. One of the first end of the outer tube and the second end of the inner tube is configured for connection to a hose of the vacuum cleaner, and the other of the first end of the outer tube and the second end of the inner tube is configured for connection to a vacuum cleaner tool. The adjustment clamp is connected to the second end of the outer tube. The adjustment clamp includes a clamp body connected to the second end of the outer tube, and a lever operatively connected to the clamp body. The clamp body includes an inner diameter, and the lever is moveable between a first, latched position and a second, unlatched position to permit selective adjustment of the inner diameter of the clamp body and selective clamping between the clamp body and the inner tube.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Figure 1:
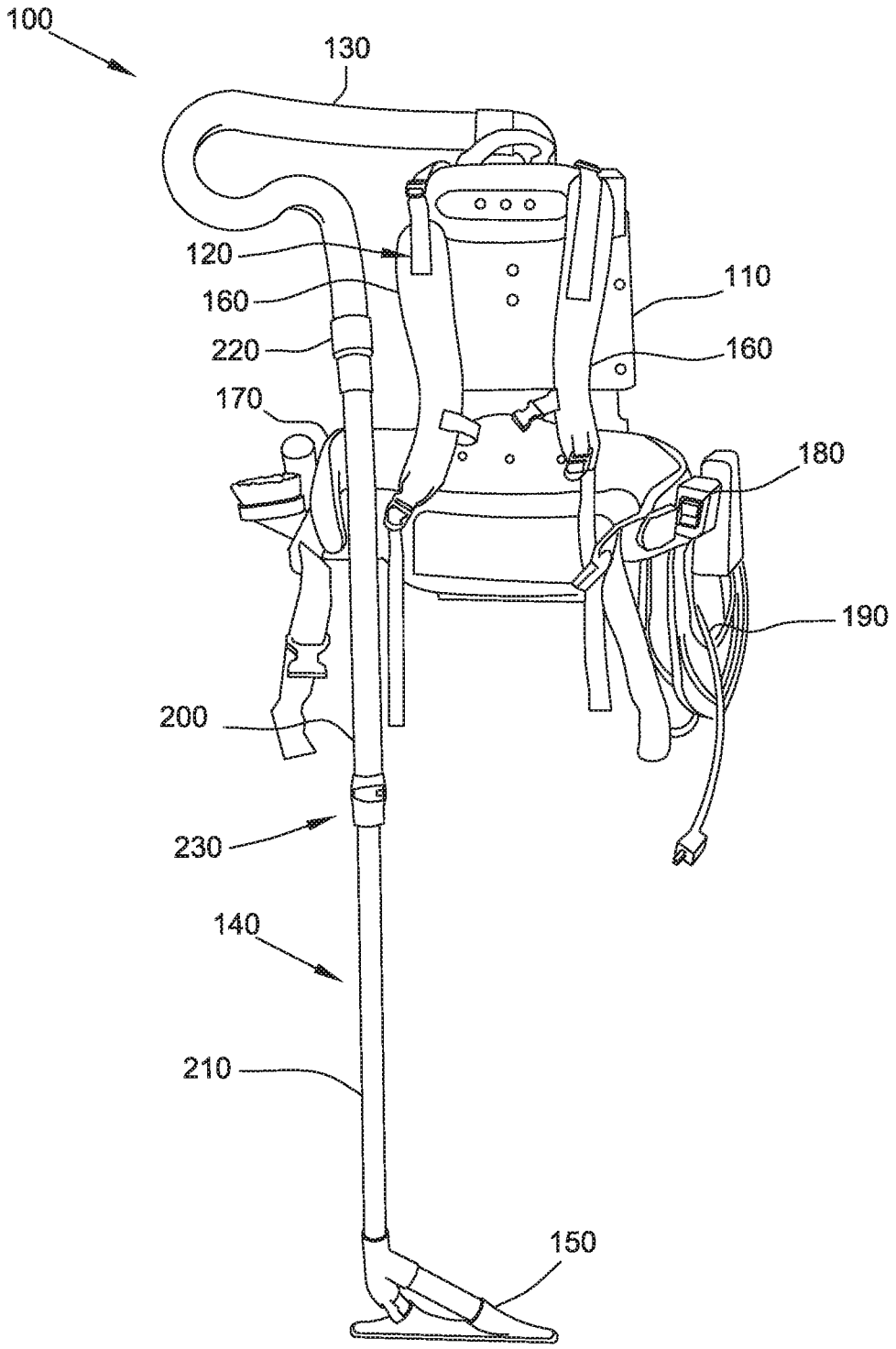
FIG. 1 is a perspective view of an example backpack vacuum cleaner including a vacuum tube assembly.

FIG. 1 is a perspective view of an example vacuum cleaner 100, shown in the form of a backpack vacuum cleaner. Although the vacuum cleaner 100 is shown and described with reference to a backpack vacuum cleaner, vacuum cleaner 100 and features thereof may be embodied in vacuum cleaners other than backpack vacuum cleaners including, for example and without limitation, canister vacuum cleaners, wet/dry vacuum cleaners, and upright vacuum cleaners. In the example embodiment, vacuum cleaner 100 generally includes a suction unit 110 that is carried on a user's back via a backpack assembly 120, a vacuum cleaner hose 130, a vacuum tube assembly 140, and a vacuum cleaner floor tool 150.

The suction unit 110 generally includes a fan and a motor (not shown) operatively connected to the fan to drive the fan and generate suction or negative pressure to permit debris and other material to be collected via vacuum tube assembly 140 and vacuum cleaner floor tool 150. The suction unit 110 may also include one or more filter assemblies and a debris container to collect and store debris collected with vacuum cleaner 100. The vacuum cleaner hose 130 extends from a top of the suction unit 110 and is connected to vacuum tube assembly 140 to permit fluid communication between the suction unit 110 and vacuum tube assembly 140. Vacuum cleaner floor tool 150 is connected to a distal end of vacuum tube assembly 140 such that vacuum cleaner floor tool 150 can be manipulated with vacuum tube assembly 140 to engage surfaces for cleaning. Although vacuum cleaner floor tool 150 is described herein as a floor cleaning tool, vacuum cleaner floor tool 150 may be used to clean surfaces other than floor surfaces. As such, vacuum cleaner floor tool 150 may also be referred to as a surface cleaning tool or, more generally, a vacuum cleaner tool. Moreover, vacuum cleaner 100 may include any other suitable surface cleaning tool connected to the distal end of vacuum tube assembly 140 that enables vacuum cleaner 100 to function as described herein.

Backpack assembly 120, which carries the suction unit 110, includes shoulder straps 160 and a waist belt 170 for securing the backpack assembly 120 to the torso of a user. In the example embodiment, vacuum cleaner 100 also includes a switch assembly 180 and a power cord assembly 190. Switch assembly 180 enables suction unit 110 to be turned on and off. In some embodiments, switch assembly 180 may be a variable position switch assembly such that switch assembly 180 provides control of the operating speed of suction unit 110. Power cord assembly 190 provides power to suction unit 110.

Figure 2:
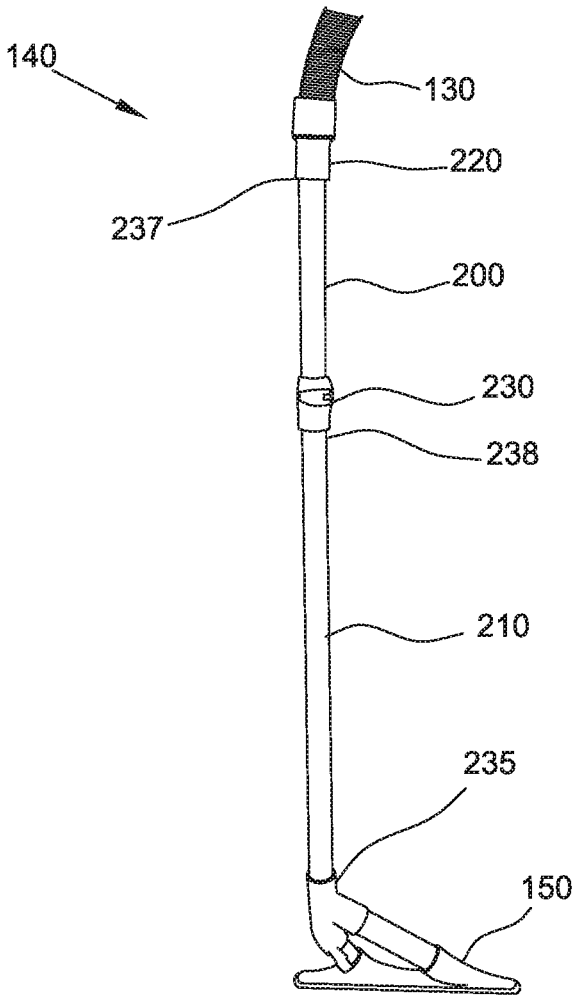
FIG. 2 is a perspective view of the vacuum tube assembly shown in FIG. 1 including an example adjustment clamp.

FIG. 2 is a perspective view of vacuum tube assembly 140 of FIG. 1. As shown in FIGS. 1 and 2, vacuum tube assembly 140 includes an inner tube 200, an outer tube 210, and an adjustment clamp 230. Outer tube 210 is connected to inner tube 200 for telescopic adjustment therewith. Each of inner tube 200 and outer tube 210 includes respective first and second ends. One of a first end 235 of the outer tube 210 and a second end 237 of inner tube 200 is configured for connection to vacuum cleaner hose 130. The other of first end 235 of outer tube 210 and second end 237 of inner tube 200 is configured for connection to vacuum cleaner tool 150. In this embodiment, vacuum cleaner hose 130 includes an inner tube attachment device 220 (shown in FIG. 1) for attaching vacuum cleaner hose 130 to second end 237 of inner tube 200. In other embodiments, vacuum cleaner hose 130 may include an outer tube attachment device for attaching vacuum cleaner hose 130 to first end 235 of outer tube 210. In this embodiment, first end 235 of outer tube 210 includes vacuum cleaner floor tool 150, which engages a surface, such as, but not limited to, a floor surface, for cleaning the same. In other embodiments, first end 235 of outer tube 210 is attached to vacuum cleaner hose 130, and second end 237 of inner tube 200 is connected to vacuum cleaner floor tool 150. A second end 238 of outer tube 210 includes adjustment clamp 230 connected thereto, which adjustably secures inner tube 200 relative to outer tube 210. In some embodiments, adjustment clamp 230 is permanently fixed to second end 238 of outer tube 210 using suitable attachment methods including, for example and without limitation, staking, gluing, or other operations.

Figure 3:
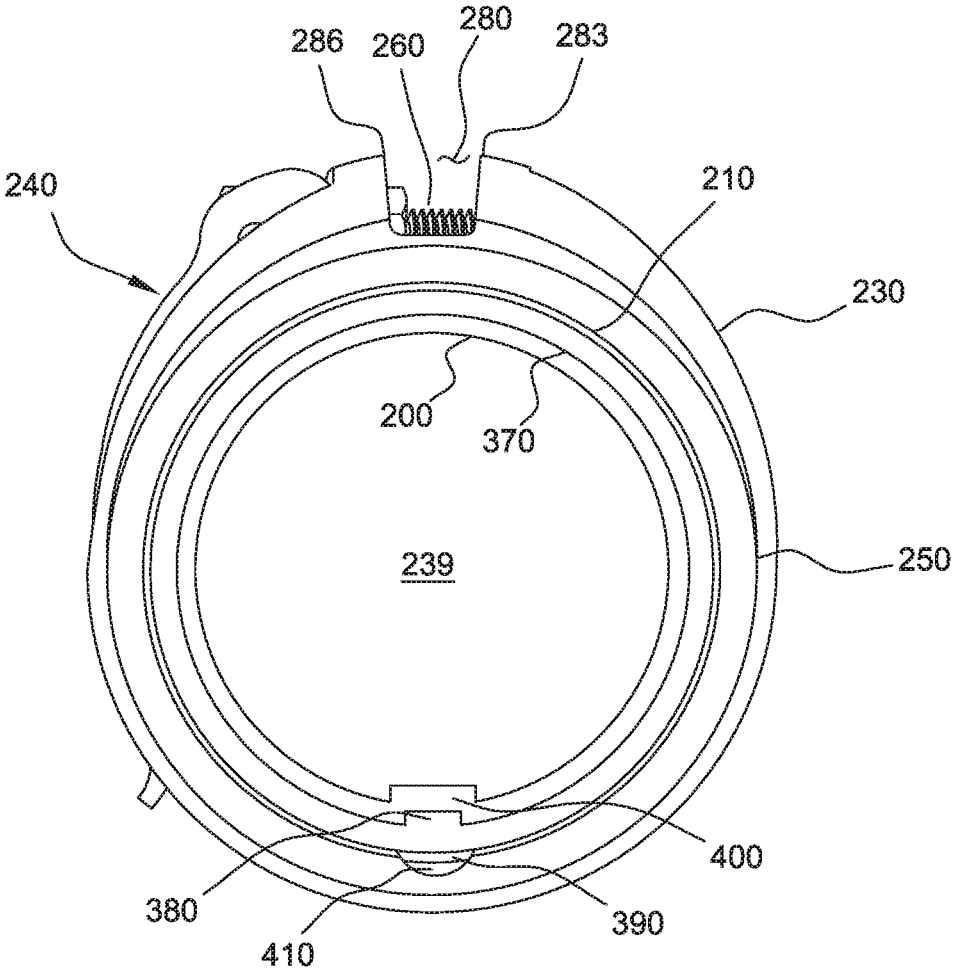
FIG. 3 is a sectional view of the vacuum tube assembly and the adjustment clamp shown in FIG. 2.

FIG. 3 is a sectional view of vacuum tube assembly 140 and adjustment damp 230. The diameter of inner tube 200 is smaller than the diameter of outer tube 210 enabling inner tube 200 to slide into outer tube 210. A vacuum passage 239 is defined by outer tube 210. Inner tube 200 slides within vacuum passage 239. Adjustment clamp 230 selectively applies a clamping force to inner tube 200 to releasably fix inner tube 200 relative to outer tube 210 and adjustment clamp 230, and to enable selective adjustment of the length of vacuum tube assembly 140. In use, a user may adjust the length of vacuum tube assembly 140 by releasing or reducing the clamping force of adjustment clamp 230 on inner tube 200, telescopically sliding inner tube 200 relative to outer tube 210, and reapplying the clamping force of adjustment clamp 230 to releasably fix inner tube 200 to adjustment clamp 230.

Figure 4:
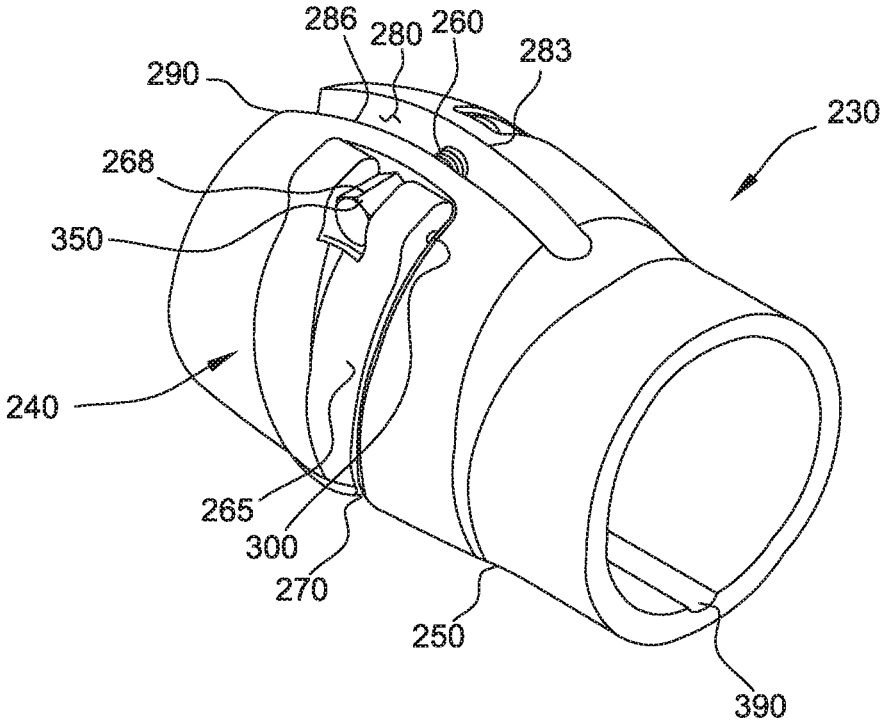
FIG. 4 is a perspective view of the adjustment clamp shown in FIG. 2, showing a lever of the adjustment clamp in a latched position.
Figure 5:
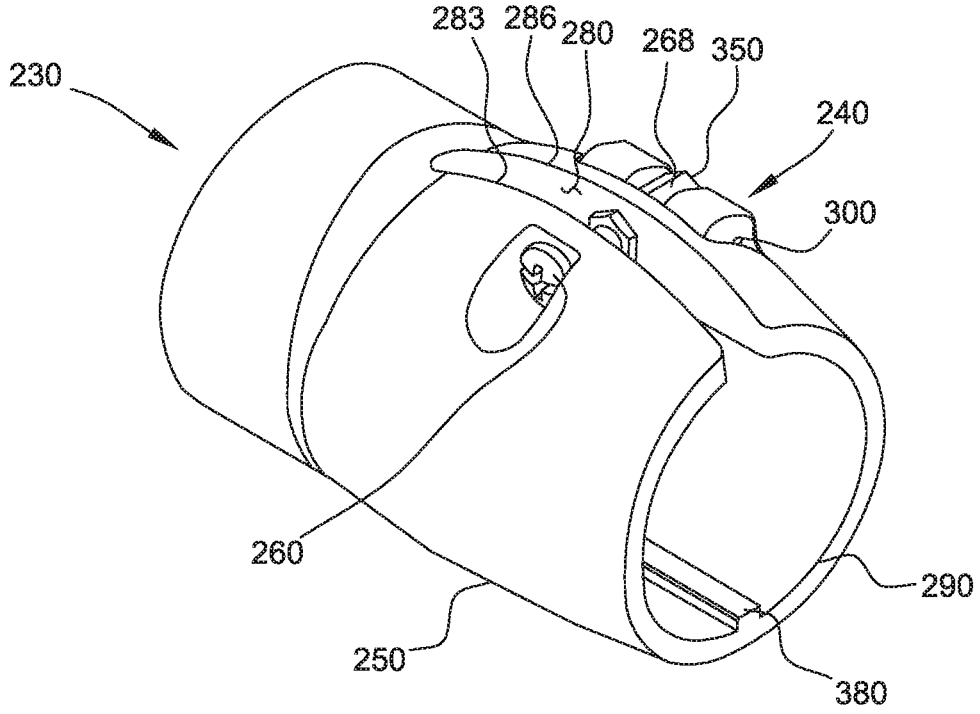
FIG. 5 is another perspective view of the adjustment clamp shown in FIG. 2.
Figure 6:
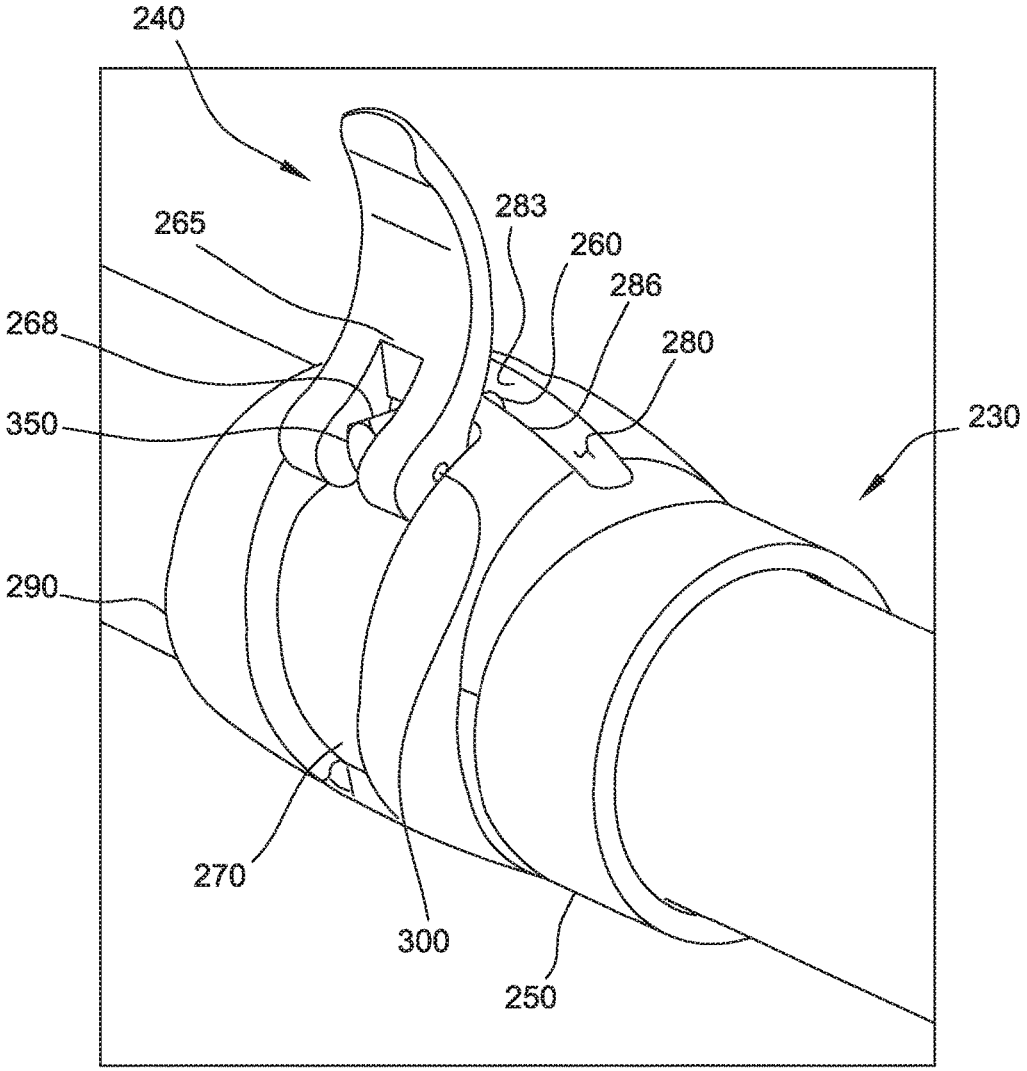
FIG. 6 is another perspective view of the adjustment clamp shown in FIG. 2, showing the lever of the adjustment clamp in an unlatched position.

With additional reference to FIGS. 4-6, adjustment clamp 230 includes a lever assembly 240, a collar or body 250, and an adjustment screw 260 (broadly, adjustment fastener). Lever assembly 240 is operatively connected to body 250 via adjustment screw 260, and is configured to permit selective adjustment of an inner diameter of body 250 and selective clamping between inner tube 200 and adjustment clamp 230. Lever assembly 240 includes a lever 265 and a pivot adapter 268. Lever 265 is operatively connected to body 250 and is moveable between a first, latched position (shown in FIGS. 3-5) and a second, unlatched position (shown in FIG. 6) to permit selective adjustment of the inner diameter of clamp body 250 and selective clamping between inner tube 200 and adjustment clamp 230.

Body 250 is connected to second end 238 of outer tube 210. Body 250 includes an ergonomic design with a smooth, contoured outer surface to conform to the user's hand, and facilitate use of adjustment clamp 230 as a handle to manipulate vacuum tube assembly 140 and vacuum cleaner floor tool 150. Additionally, body 250 includes a recessed portion 270 configured to receive lever 265 therein when lever 265 is in the latched position such that lever 265 is conformal with an outer surface of body 250. Body 250 also defines a compression slot 280 between spaced apart first and second longitudinal edges 283 and 286. Compression slot 280 extends from a first end 290 of body 250 past lever assembly 240. Pivot adapter 268 pivotably connects lever 265 to body 250 and thereby allows lever 265 to pivot relative to body 250. Adjustment screw 260 extends through first longitudinal edge 283 and second longitudinal edge 286 and connects to pivot adapter 268, securing lever assembly 240 to body 250. The damping force of adjustment damp 230, which secures inner tube 200 relative to outer tube 210, may be selectively adjusted by tightening or loosening adjustment screw 260 relative to pivot adapter 268. In other embodiments, adjustment screw 260 may be any suitable adjustable fastener that enables adjustment clamp 230 to function as described herein, including, for example and without limitation, a thumb screw or any other type of screw. In another embodiment, lever assembly 240 may be configured to adjust the length of adjustment screw 260 by tightening or loosening adjustment screw 260 relative to pivot adapter 268.

Figure 7:
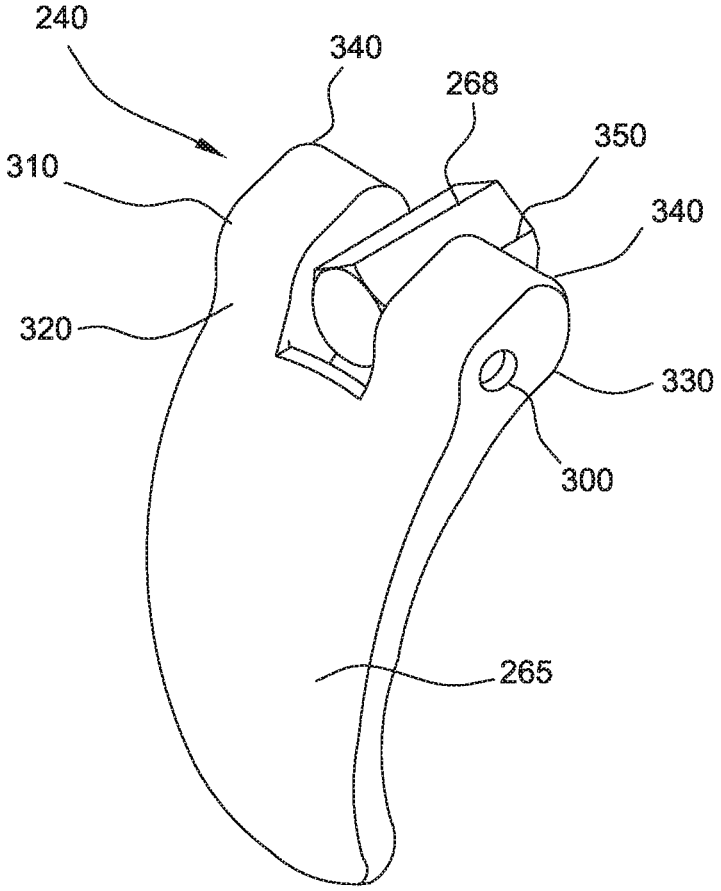
FIG. 7 is a perspective view of an example lever assembly of the adjustment clamp shown in FIG. 2.
Figure 8:
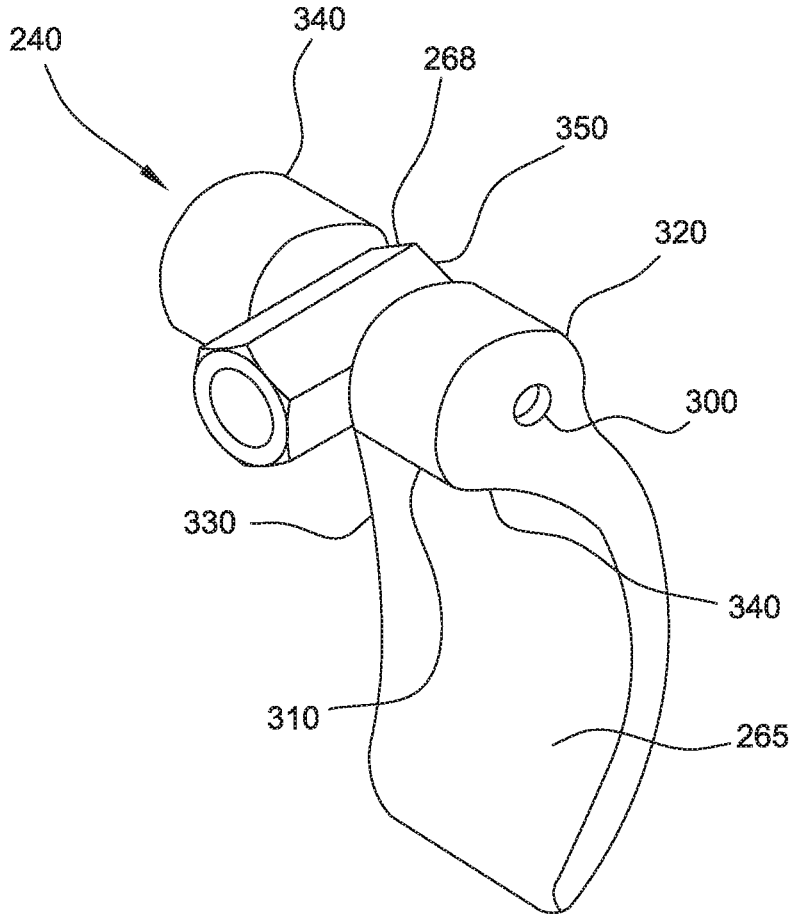
FIG. 8 is another perspective view of the lever assembly shown in FIG. 7.
Figure 9:
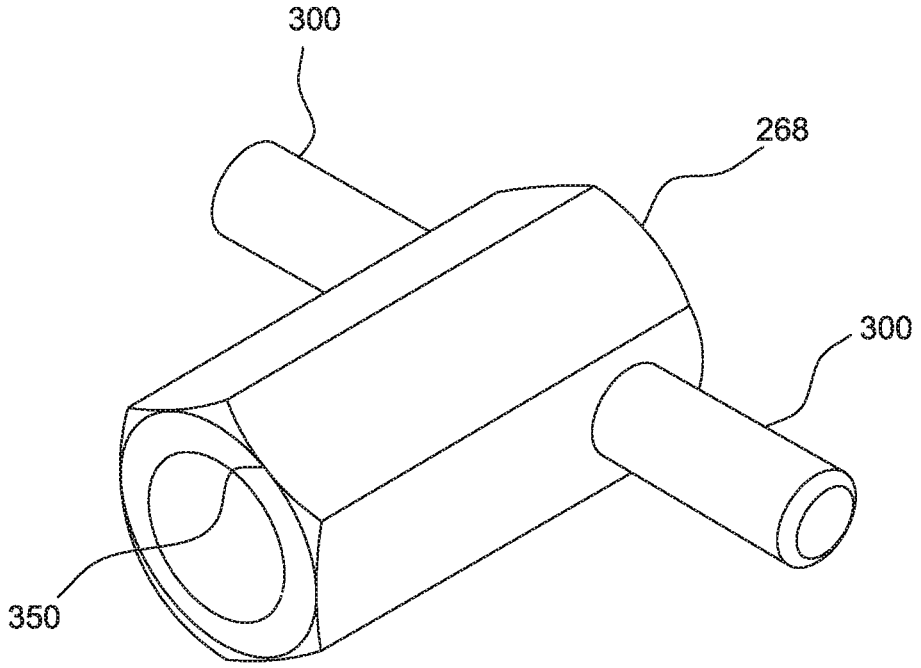
FIG. 9 is a perspective view of a pivot adapter of the lever assembly shown in FIG. 7.

FIGS. 7 and 8 are perspective views of lever assembly 240, and FIG. 9 is a perspective view of pivot adapter 268. With additional reference to FIGS. 7-9, lever 265 is pivotably connected to pivot adapter 268 via a pivot pin 300, which allows lever 265 to pivot relative to body 250. Pivot pin 300 defines a rotational axis about which lever 265 rotates when moved between the latched position and the unlatched position. Lever 265 includes a pivot end 310. Pivot end 310 includes a radial outer surface 320 and a radial inner surface 330. Radial outer surface 320 follows the curvature of body 250 and faces away from body 250 when lever 265 is in the latched position. Radial inner surface 330 also follows the curvature of body 250 and faces towards body 250 when lever 265 is in the latched position. As lever 265 is rotated about pivot pin 300 towards the latched position, a cam surface 340 engages second longitudinal edge 286, and gradually moves pivot pin 300 away from second longitudinal edge 286. As pivot pin 300 moves away from second longitudinal edge 286, pivot pin 300 pulls pivot adapter 268 away from first longitudinal edge 283 and imparts a tensile force to adjustment screw 260. Adjustment screw 260 imparts the force to first longitudinal edge 283, thereby imparting a compressive force between first longitudinal edge 283 and second longitudinal edge 286, decreasing the inner diameter of body 250, and imparting a clamping force against inner tube 200.

With additional reference to FIG. 9, pivot adapter 268 includes an adjustment screw socket 350 and pivot pin 300. Adjustment screw socket 350 includes threading configured to accept adjustment screw 260. Pivot pin 300 extends through adjustment screw socket 350 and hingedly connects lever 265 to pivot adapter 268, thereby forming lever assembly 240. Adjustment screw 260 secures lever assembly 240 to body 250, thereby forming adjustment damp 230. Tightening adjustment screw 260 increases the clamping force on inner tube 200.

Figure 10:
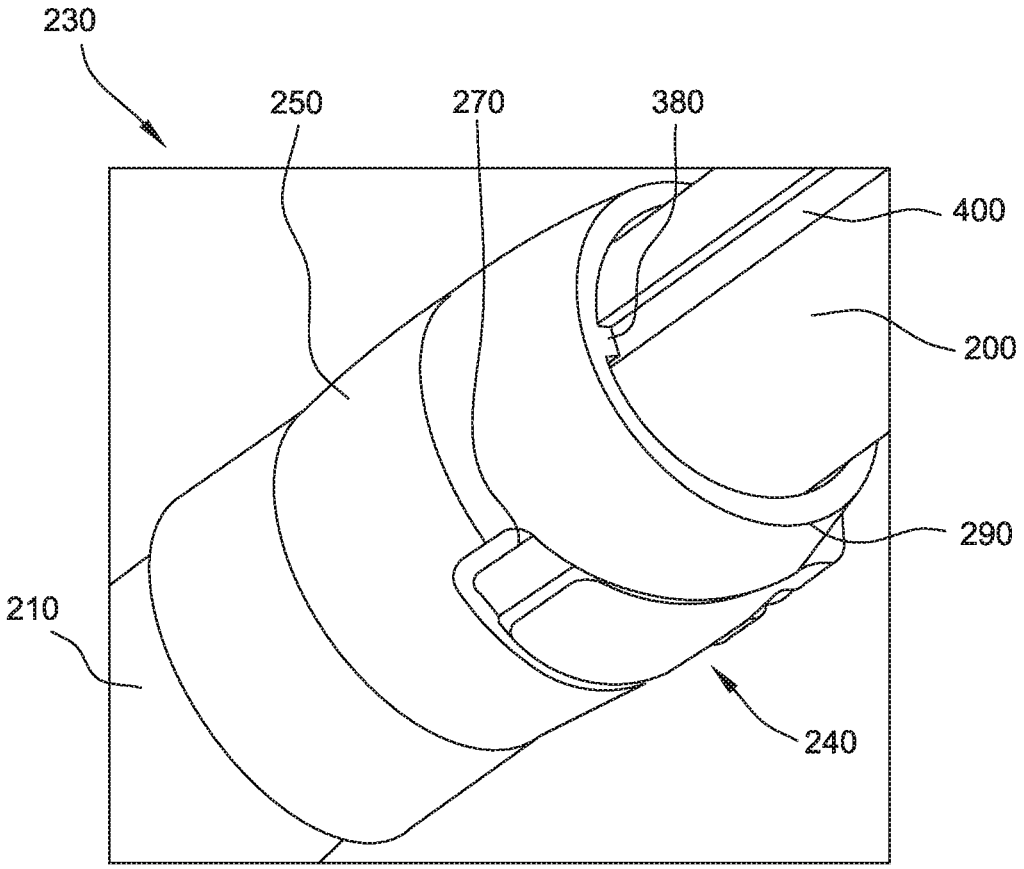
FIG. 10 is a perspective view of the adjustment clamp shown in FIG. 2 connected to the vacuum tube assembly shown in FIG. 1.
Figure 11:
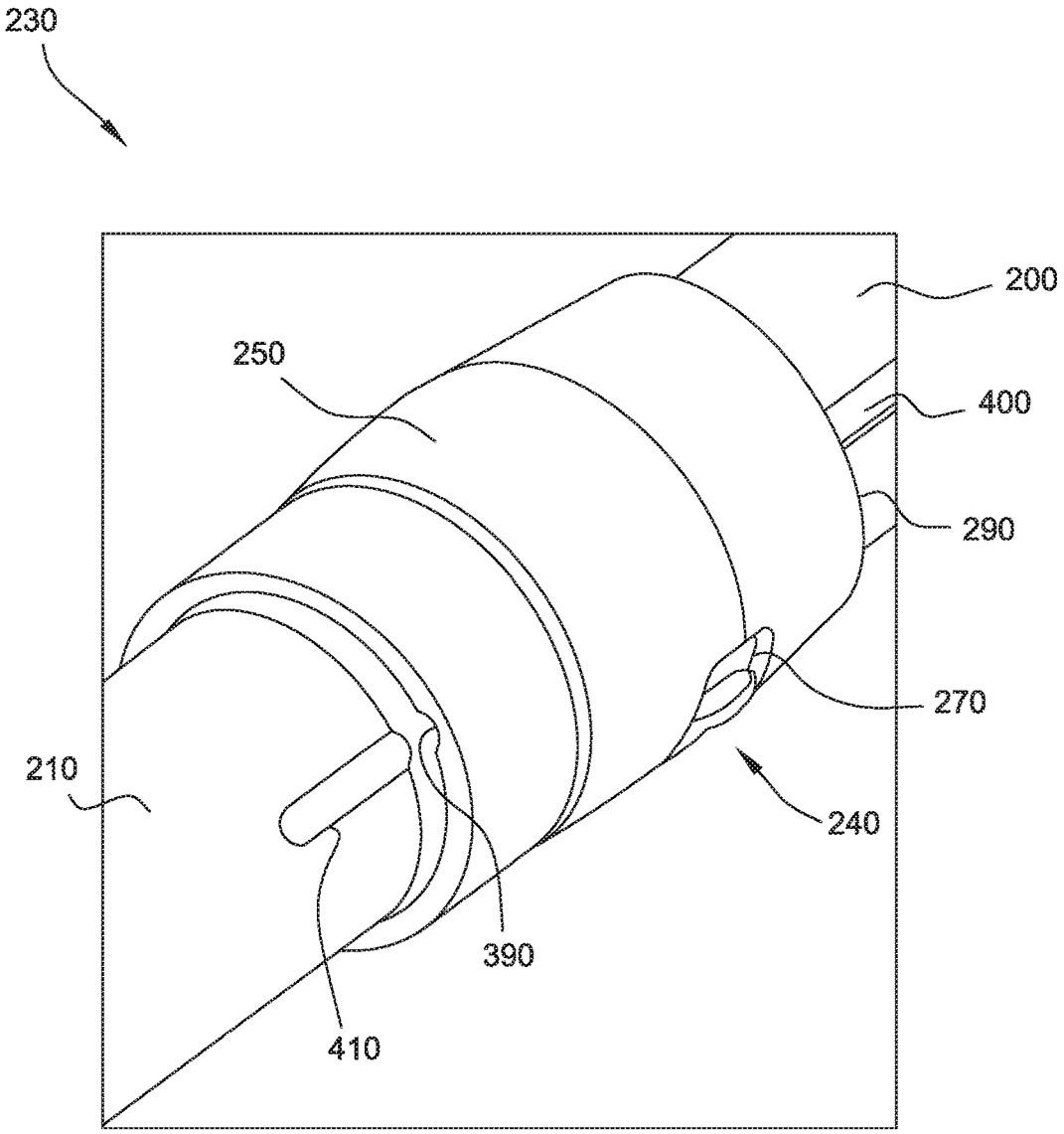
FIG. 11 is another perspective view of the adjustment clamp shown in FIG. 2 connected to the vacuum tube assembly shown in FIG. 1.

In some embodiments, body 250 includes one or more alignment features to facilitate maintaining a relative rotational position between inner tube 200 and outer tube 210. For example, as shown in FIGS. 4 and 5, body 250 includes a damp alignment protrusion 380 and a damp alignment slot 390. FIGS. 10 and 11 are perspective views of the adjustment clamp 230 connected to the vacuum tube assembly 140. As shown in FIGS. 10 and 11, inner tube 200 includes a tube alignment slot 400, and outer tube 210 includes a tube alignment protrusion 410. Tube alignment slot 400 is sized and shaped complementary to damp alignment protrusion 380, and tube alignment protrusion 410 is sized and shaped complementary to damp alignment slot 390. When vacuum tube assembly 140 is assembled, damp alignment protrusion 380 is received within tube alignment slot 400 such that clamp alignment protrusion 380 engages tube alignment slot 400 and thereby permits relative axial motion between inner tube 200 and damp body 250, and inhibits rotational motion between inner tube 200 and clamp body 250. Further, when vacuum tube assembly 140 is assembled, tube alignment protrusion 410 is received within damp alignment slot 390 such that tube alignment protrusion 410 engages damp alignment slot 390. Body 250 is permanently fixed to outer tube 210 by a staking, gluing, or other operation, inhibiting motion of outer tube 210 relative to adjustment clamp 230, and ensuring outer tube 210 remains aligned with inner tube 200, adjustment clamp 230, and floor tool 150. Maintaining a desired relative rotational position between inner tube 200 and outer tube 210 may be particularly advantageous when inner tube 200 and/or outer tube 210 are non-linear tubes (i.e., include a non-linear portion), such as S-shaped tubes.

Figure 12:
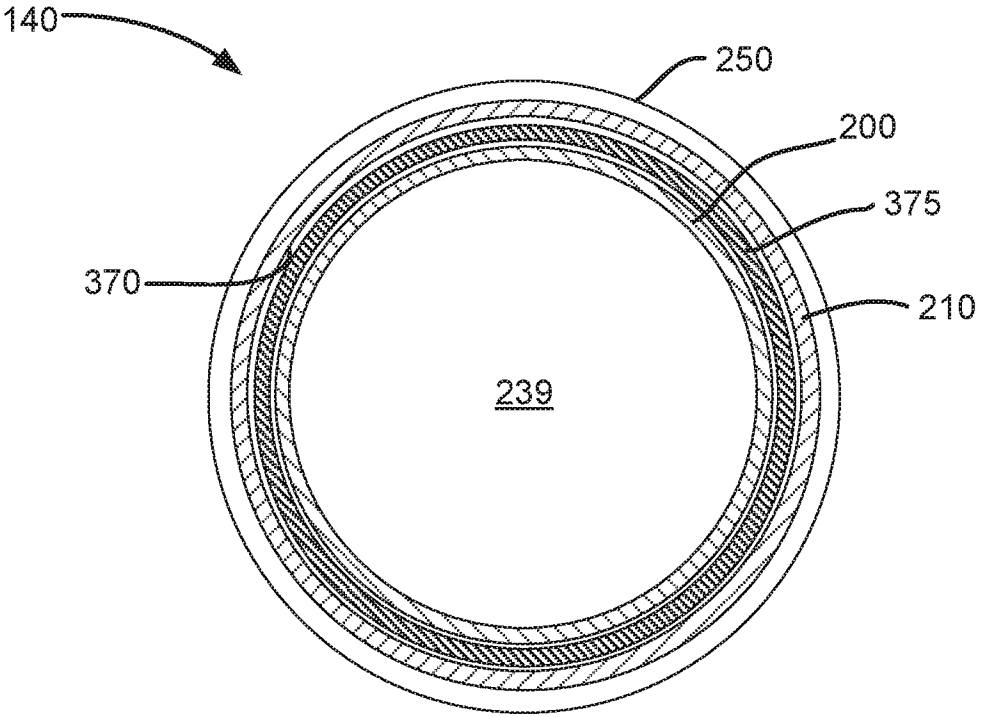
FIG. 12 is a schematic cross section of the vacuum tube assembly shown in FIG. 1 including a seal.

In some embodiments, outer tube 210 may include a plurality of seals fixed to a radial inner surface 370 of outer tube 210 and disposed between outer tube 210 and inner tube 200. FIG. 12, for example, is a schematic cross section of vacuum tube assembly 140 including a seal 375 fixed to radial inner surface 370 of outer tube 210 and disposed between outer tube 210 and inner tube 200. The spacing between inner tube 200, outer tube 210, clamp body 250, and seal 375 is exaggerated in FIG. 12 for illustrative purposes. Such seals may be configured to prevent air from escaping vacuum tube assembly 140. Additionally or alternatively, body 250 may include a plurality of seals, such as seal 375, fixed to a radial inner surface of body 250 and disposed between body 250 and inner tube 200 to form a seal around inner tube 200. Further, in some embodiments, body 250 may include a textured feature, such as ribs, along a radial inner surface of body 250 to enhance the frictional force between body 250 and inner tube 200 and inhibit sliding of inner tube 200 relative to adjustment clamp 230.

In some embodiments, body 250 may include a bleed hole (not shown) extending radially through body 250 to an exit hole (not shown) located within recessed portion 270. When lever 265 is in the latched position, lever 265 seals the bleed hole, maintaining suction throughout the vacuum tube assembly 140. When an obstruction has blocked vacuum tube assembly 140, lever 265 may be moved to the unlatched position, unsealing the bleed hole. The unsealed bleed hole reduces the suction force in vacuum tube assembly 140 and allows the obstruction to fall away from vacuum tube assembly 140 without turning off vacuum cleaner 100.

Additionally, in some embodiments, inner tube 200 and/or outer tube 210 may include a plurality of compression slots (not shown) extending axially inward from an end of the respective inner tube 200 or outer tube 210 to facilitate flexing of the respective inner tube 200 and outer tube 210. Adjustment clamp 230 is a quick clamp which allows the user to quickly open lever assembly 240 and adjust the length of vacuum tube assembly 140 without ceasing operation of vacuum cleaner 100.

With reference to FIGS. 1-11, in operation, the length of vacuum tube assembly 140 may be selectively adjusted by releasing or reducing the clamping force imparted to inner tube 200, and telescopically sliding inner tube 200 relative to outer tube 210 until vacuum tube assembly 140 has a desired length. Once vacuum tube assembly 140 has the desired length, the clamping force of adjustment clamp 230 may be reapplied to inner tube 200 to releasably fix inner tube 200 relative to outer tube 210 and adjustment clamp 230. The clamping force of adjustment clamp 230 is reduced by moving lever 265 from the latched position (shown in FIGS. 3-5) to the unlatched position (shown in FIG. 6). Moving lever 265 from the latched to the unlatched position allows pivot pin 300 to move towards first and second longitudinal edges 283 and 286, and thereby reduces the compressive force applied to first longitudinal edge 283 and second longitudinal edge 286 by adjustment screw 260 and cam surface 340. The clamping force of adjustment clamp 230 is reapplied by moving lever 265 from the unlatched position to the latched position. As lever 265 is rotated about pivot pin 300 towards the latched position, cam surface 340 engages second longitudinal edge 286, and gradually moves pivot pin 300 away from second longitudinal edge 286. As pivot pin 300 moves away from second longitudinal edge 286, pivot pin 300 pulls pivot adapter 268 away from first longitudinal edge 283 and imparts a tensile force to adjustment screw 260. Adjustment screw 260 imparts the force to first longitudinal edge 283, thereby imparting a compressive force between first longitudinal edge 283 and second longitudinal edge 286, decreasing the inner diameter of body 250, and imparting a clamping force to inner tube 200.

Figure 13:
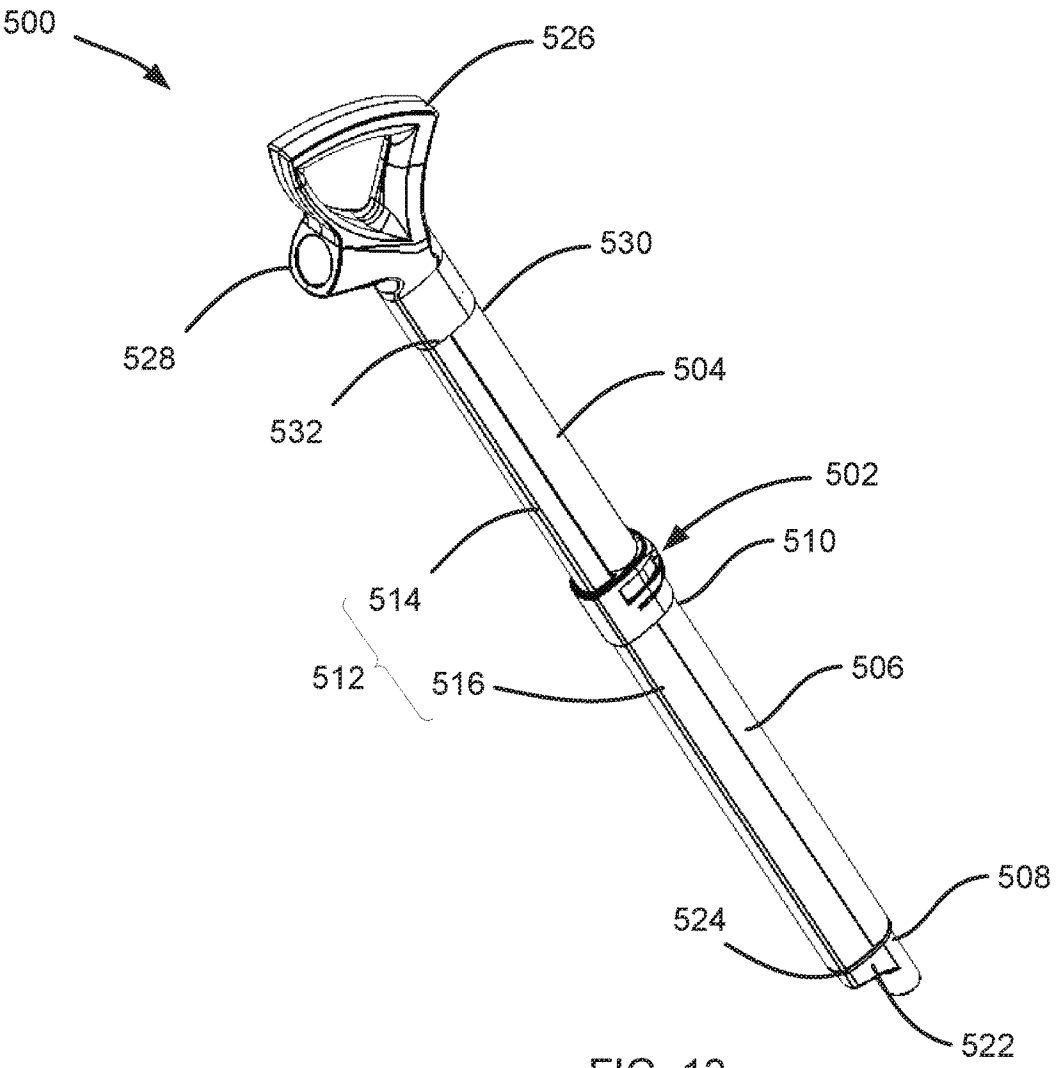
FIG. 13 is a perspective view of another embodiment of a vacuum tube assembly including an adjustment damp.

FIG. 13 is a perspective view of another embodiment of a vacuum tube assembly 500 including an adjustment clamp 502. Unless otherwise noted, vacuum tube assembly 500 is substantially identical to vacuum tube assembly 140 shown and described above with reference to FIGS. 1-11.

Figure 18:
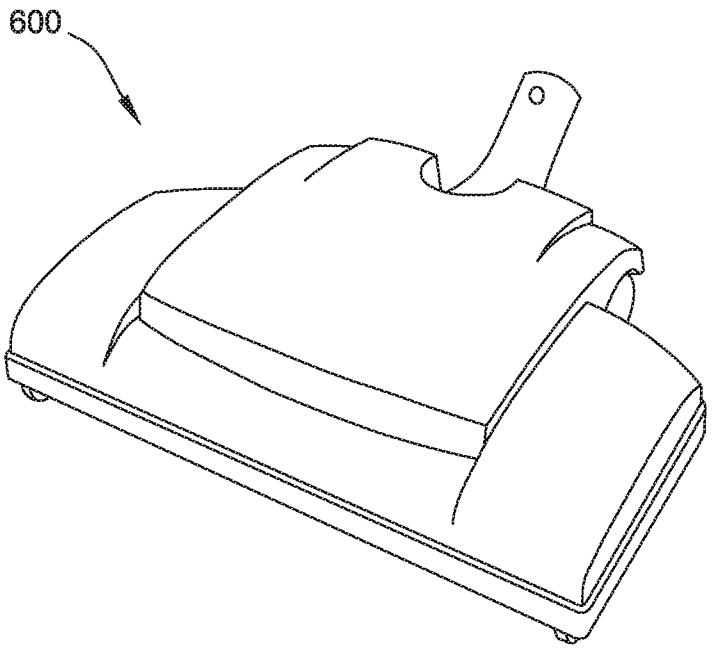
FIG. 18 is a perspective view of an example powered floor tool suitable for use with the vacuum tube assembly shown in FIG. 13.

Vacuum tube assembly 500 includes an inner tube 504, an outer tube 506, and adjustment damp 502. Outer tube 506 is connected to inner tube 504 for telescopic adjustment therewith. Each of inner tube 504 and outer tube 506 include respective first and second ends. In use, a first end 508 of outer tube 506 is connected to a vacuum cleaner floor, such as vacuum cleaner floor tool 150 (FIG. 1). In some embodiments, the floor tool connected to vacuum tube assembly 500 is a powered floor tool—i.e., a floor tool including at least one electrically-powered component including, for example and without limitation, a light and a rotary brush. FIG. 18 is a perspective view of an example powered floor tool 600 embodied in a rotary brush head. A second end 510 of outer tube 506 includes adjustment damp 502, which adjustably secures inner tube 504 relative to outer tube 506. In some embodiments, adjustment clamp 502 is permanently fixed to second end 510 of outer tube 506 using suitable attachment methods including, for example and without limitation, staking, gluing, or other operations.

Figure 14:
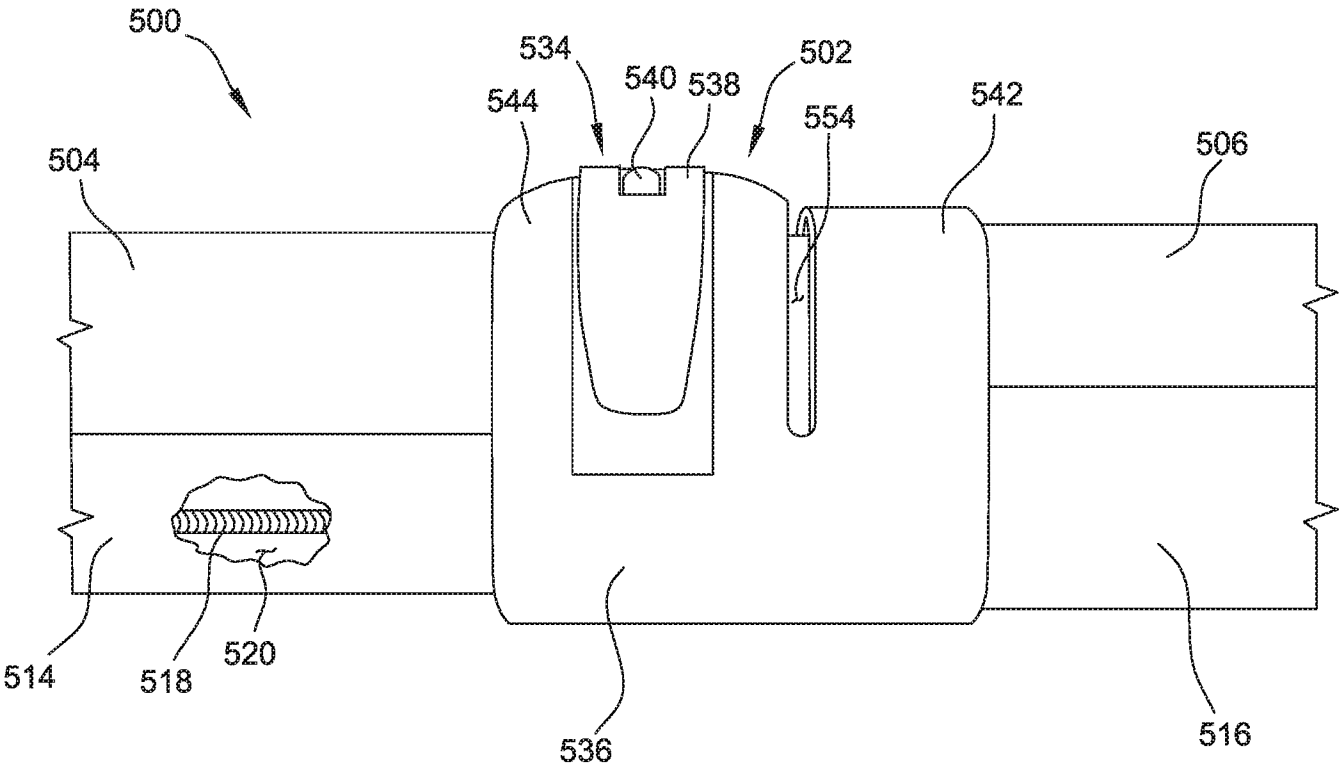
FIG. 14 is an enlarged side view of the vacuum tube assembly shown in FIG. 13

In this embodiment, vacuum tube assembly 500 is configured for use with powered floor tools, and may be referred to as a powered floor tool wand or powered floor tool vacuum tube assembly. For example, vacuum tube assembly 500 includes an electrical conduit tube assembly 512 including an inner conduit tube 514 and an outer conduit tube 516. Inner conduit tube 514 extends into outer conduit tube 516, and is connected to outer conduit tube 516 for telescopic adjustment therewith such that a length of electrical conduit tube assembly 512 may be selectively adjusted. A portion of inner conduit tube 514 is cutaway in FIG. 14. As shown in FIG. 14, an electrical conduit 518 extends through a conduit passage 520 defined by inner conduit tube 514 and outer conduit tube 516. Electrical conduit 518 is connected to an electrical connector 522 (FIG. 13) disposed at a first end 524 of outer conduit tube 516. Electrical connector 522 is configured to electrically connect a powered floor tool to electrical conduit 518 such that electrical conduit 518 supplies electrical power to the powered floor tool. In use, electrical conduit 518 is electrically connected to a suitable power supply, such as a battery or a wall outlet, and supplies electrical power to a powered floor tool. In this embodiment, electrical conduit 518 is a coiled, retractable conduit such that electrical conduit 518 extends and retracts as a length of vacuum tube assembly 500 is adjusted. Electrical conduit 518 thereby permits vacuum tube assembly 500 to be freely adjusted.

Electrical conduit tube assembly 512 encloses electrical conduit 518 within conduit passage 520, and facilitates preventing electrical conduit 518 from damage and from becoming entangled with foreign objects. In some embodiments, electrical conduit tube assembly 512, including inner conduit tube 514 and outer conduit tube 516, are constructed of lightweight plastics, including, for example and without limitation, polypropylene (PP), acrylonitrile butadiene styrene (ABS), and other general use resins. In some embodiments, electrical conduit tube assembly 512 is constructed of materials with suitable impact properties to withstand normal use in commercial cleaning applications.

In this embodiment, vacuum tube assembly 500 also includes a handle 526 to facilitate manipulation of vacuum tube assembly 500. Handle 526 includes a vacuum hose connector 528 that connects to a vacuum cleaner hose, such as hose 130 (FIG. 1), to provide suction to vacuum tube assembly 500. In this embodiment, a first end 530 of inner tube 504 and a first end 532 of inner conduit tube 514 are fixed to handle 526 such that inner tube 504 and inner conduit tube 514 can be moved in unison by moving handle 526. In other words, the length of vacuum tube assembly 500 can be selectively adjusted by moving handle 526 towards and away from outer tube 506 and outer conduit tube 516.

Adjustment clamp 502 operates similarly to adjustment clamp 230 described above with references to FIGS. 1-11. In particular, adjustment clamp 502 selectively applies a clamping force to inner tube 504 to releasably fix inner tube 504 relative to outer tube 506 and adjustment damp 502, and to enable selective adjustment of the length of vacuum tube assembly 500. In use, a user may adjust the length of vacuum tube assembly 500 by releasing or reducing the clamping force of adjustment damp 502 on inner tube 504, telescopically sliding inner tube 504 relative to outer tube 506 while simultaneously telescopically sliding inner conduit tube 514 relative to outer conduit tube 516, and reapplying the damping force of adjustment damp 502 to releasably fix inner tube 504 to adjustment damp 502.

Referring again to FIG. 14, adjustment clamp 502 includes a lever assembly 534, a damp body 536; and an adjustment screw (not shown in FIG. 14). Lever assembly 534 and adjustment screw are identical to and operate in the same manner as lever assembly 240 and adjustment screw 260, respectively, described above with reference to FIGS. 1-11. For example, lever assembly 534 includes a lever 538 and a pivot adapter 540. Lever 538 is operatively connected to body 536 and is moveable between a first, latched position (shown in FIG. 14) and a second, unlatched position (not shown) to permit selective adjustment of an inner diameter of clamp body 536 and selective clamping between inner tube 504 and adjustment clamp 502.

In this embodiment, damp body 536 includes a connector portion 542 and a clamping portion 544. Connector portion 542 is connected to second end 510 of outer tube 506. In some embodiments, connector portion 542 is permanently fixed to second end 510 of outer tube 506. Clamping portion 544 selectively applies a clamping force to inner tube 504 to releasably fix inner tube 504 relative to outer tube 506 and adjustment clamp 502, and to enable selective adjustment of the length of vacuum tube assembly 500.

Lever assembly 534 is operatively connected to clamping portion 544 of body 536 via the adjustment screw, and is configured to permit selective adjustment of an inner diameter of clamping portion 544 and selective clamping between inner tube 504 and adjustment clamp 502. Thus, an inner diameter of connector portion 542 remains relatively fixed while the inner diameter of clamping portion 544 is selectively adjustable by actuation of lever assembly 534 to selectively clamp inner tube 504 with adjustment clamp 502.

Figure 15:
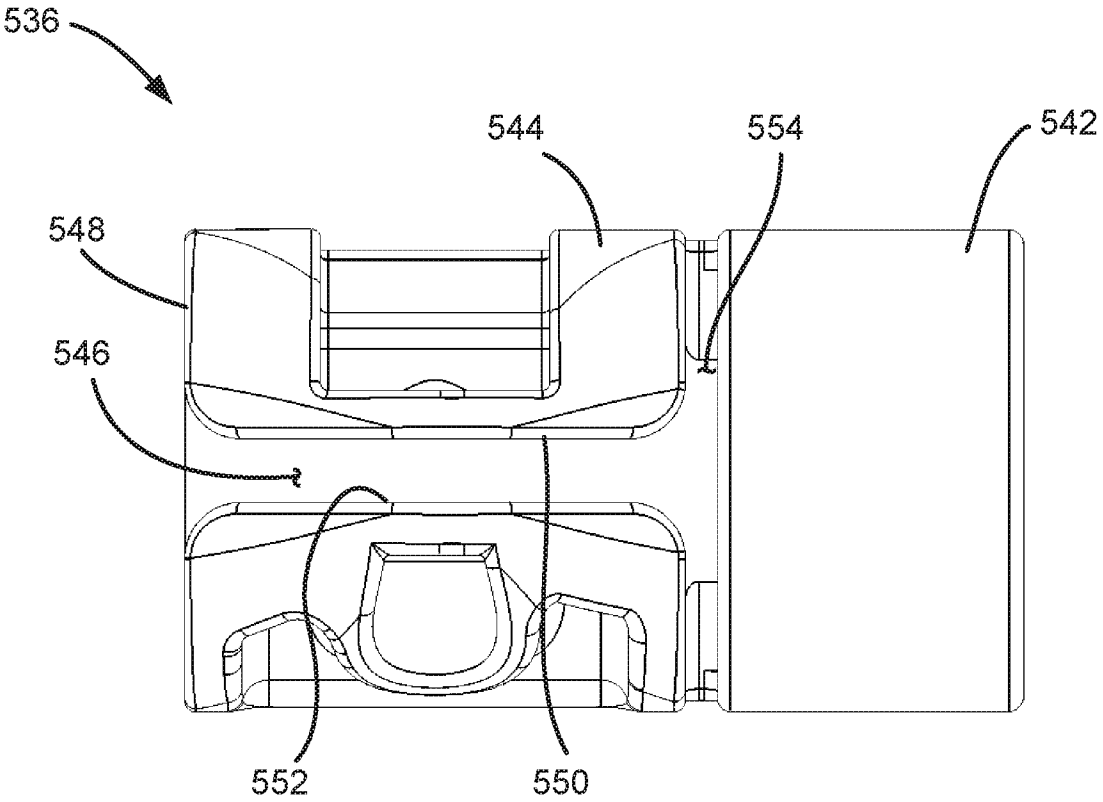
FIG. 15 is a top view of a clamp body of the adjustment clamp shown in FIG. 13.
Figure 16:
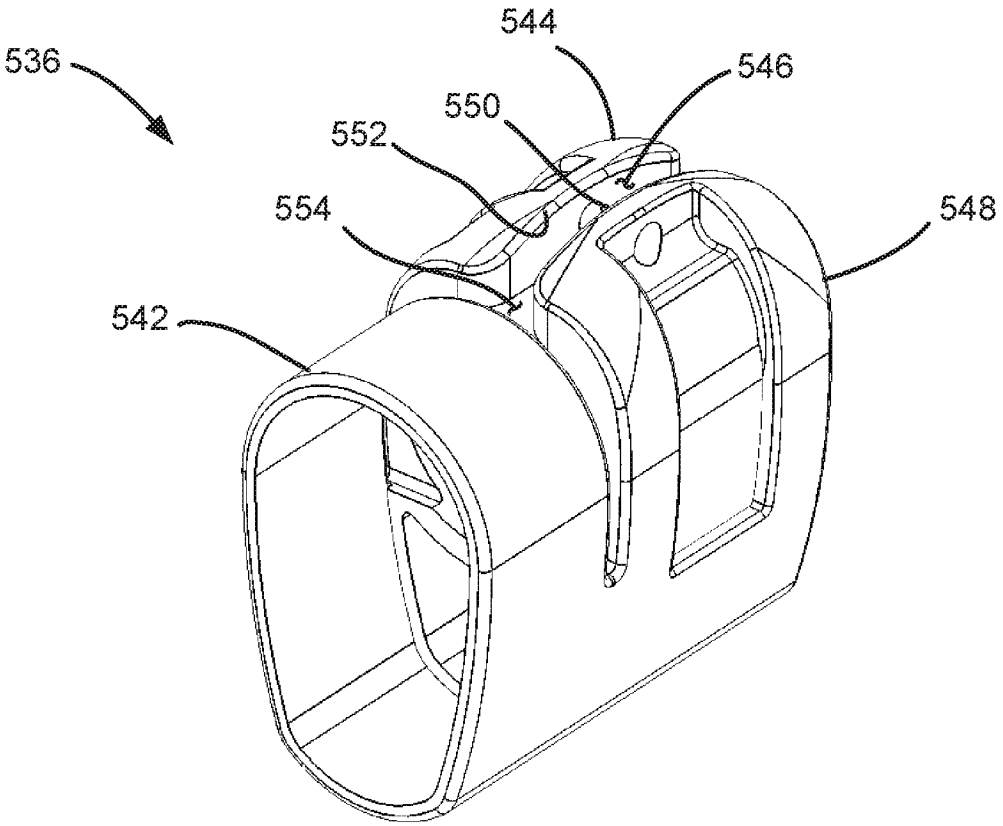
FIG. 16 is a perspective view of the clamp body shown in FIG. 15.

With additional reference to FIGS. 15 and 16, body 536, specifically clamping portion 544 of body 536, defines a compression slot 546 extending from a first end 548 of body 536, and between spaced apart first and second longitudinal edges 550 and 552. Compression slot 546 extends from first end 548 of body 536 past lever assembly 534 (shown in FIG. 14). Lever 538 is connected to clamping portion 544, and is operable to pull first and second longitudinal edges 550, 552 toward each other and cause clamp body 536 to releasably fix inner tube 504 relative to outer tube 506 in substantially the same manner as described above with reference to FIGS. 1-11. In particular, actuation of lever 538 imparts a compressive force between first longitudinal edge 550 and second longitudinal edge 552, decreasing the inner diameter of clamping portion 544 of body 536, and imparting a clamping force against inner tube 504.

Additionally, in this embodiment, body 536 defines a circumferential or relief slot 554 extending generally perpendicular to compression slot 546, and circumferentially around clamp body 536. In this embodiment, compression slot 546 extends into relief slot 554 to define a single, continuous, "T"-shaped slot extending through clamp body 536. Relief slot 554 is defined by and between connector portion 542 and clamping portion 544 such that clamping portion 544 is spaced longitudinally from connector portion 542. Relief slot 554 extends partially around clamp body 536 in this embodiment.

Relief slot 554 acts to limit or reduce the mechanical connection between connector portion 542 and clamping portion 544, thereby allowing greater freedom of movement of longitudinal edges 550 and 552 for a given force as compared to an adjustment clamp without relief slot 554. This also limits the force or movement imparted to portions of body 536 other than clamping portion 544, and thereby reduces or limits the risk of adjustment clamp 502 clamping or compressing conduit tube assembly 512, which may otherwise result in deformation of conduit tube assembly 512.

Additionally, relief slot 554 facilitates movement of longitudinal edges 550, 552 in substantially opposite directions upon actuation of lever assembly 534, as compared to rotational movement about the end of compression slot 546. This results in an increase in surface area engagement, and thus, clamping force, between clamping portion 544 and inner tube 504 for a given clamping force, as compared to an adjustment clamp without relief slot 554. Accordingly, relief slot 554 facilitates enhancing the clamping force applied to inner tube 504 with adjustment clamp 502, and facilitates decreasing the amount of force needed to be applied to lever assembly 534 to actuate lever assembly 534.

Figure 17:
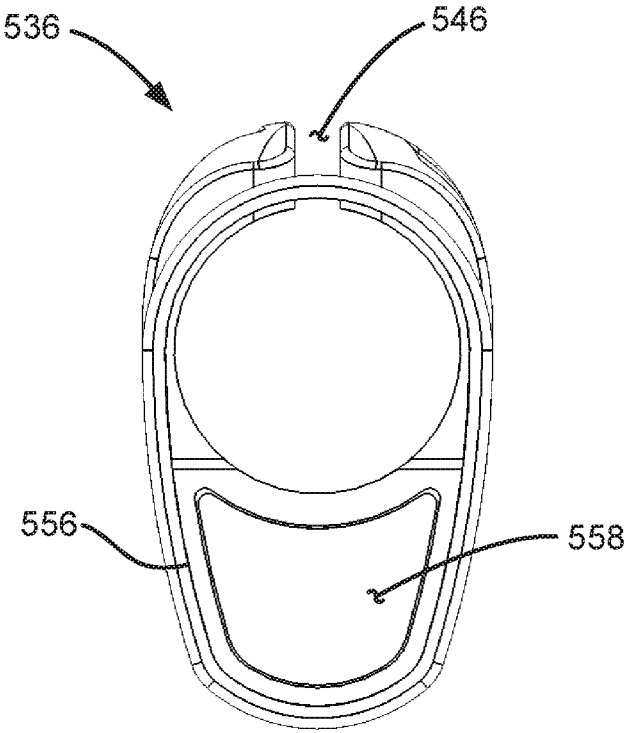
FIG. 17 is an end view of the clamp body shown in FIG. 15.

With additional reference to FIG. 17, in this embodiment, clamp body 536 includes a conduit tube sleeve 556 defining an opening 558 extending longitudinally through the clamp body 536. Opening 558 is sized and shaped complementary to inner conduit tube 514 such that inner conduit tube 514 may freely slide through opening 558. When vacuum tube assembly 500 is assembled, conduit tube assembly 512, specifically, inner conduit tube 514, extends through opening 558. Conduit tube sleeve 556 facilitates maintaining alignment between inner conduit tube 514 and outer conduit tube 516, and holds inner conduit tube 514 and outer conduit tube 516 adjacent the inner tube 504 and outer tube 506, respectively.

Embodiments of the systems described achieve superior results as compared to prior art systems. For example, the vacuum tube assemblies include an adjustment clamp that permits the length of the vacuum tube assembly to be more quickly and easily adjusted, and uses a clamping force to releasably fix the inner tube relative to the outer tube. The adjustment clamp includes a lever assembly that allows the clamping force applied to the inner tube to be selectively adjusted by moving a lever between a latched and unlatched position. The relatively simple motion of the lever assembly as compared to prior vacuum tube adjustment systems permits relatively quick and easy adjustments of the length of the vacuum tube assembly. Additionally, the relatively simple motion permits quick and easy assembly and disassembly of inner tube from vacuum tube assembly, permitting use of inner tube as a vacuum tube.

Additionally, embodiments of vacuum tube assemblies described herein include an adjustment clamp with a relief slot separating a connector portion of the adjustment clamp from a clamping portion of the adjustment clamp. In some embodiments, the relief slot acts to limit or reduce the mechanical connection between the connector portion and the clamping portion, thereby reducing the amount of force or stress needed to apply a clamping force with the clamping portion. This also limits the force or movement imparted to portions of the adjustment clamp other than the clamping portion, thereby reducing or limiting the risk of the adjustment clamp applying a clamping or compressive force to portions of the vacuum tube assembly other than vacuum tubes. Additionally, the relief slot may facilitate movement of longitudinal edges of the clamping portion in substantially opposite directions, rather than rotational movement of the longitudinal edges. This results in an increase in surface area engagement, and thus, clamping force, between the clamping portion and a vacuum tube for a given clamping force, as compared to an adjustment clamp without a relief slot. Accordingly, in some embodiments, the relief slot facilitates enhancing the clamping force applied to vacuum tubes with an adjustment clamp, and facilitates decreasing the amount of force needed to be applied to a lever assembly of the adjustment clamp to actuate the lever assembly.

Example embodiments of vacuum cleaner tube assemblies and adjustment clamps are described above in detail. The vacuum tube assemblies and adjustment clamps are not limited to the specific embodiments described herein, but rather, components of the vacuum tube assemblies and adjustment clamps may be used independently and separately from other components described herein. For example, the vacuum tube assemblies described herein may be used in vacuum cleaners other than backpack vacuum cleaners, including without limitation floor vacuum cleaners and stationary vacuum cleaners. Additionally, features described with reference to one embodiment may be implemented in other embodiments of the vacuum tube assembly. For example, features described with reference to vacuum tube assembly 140 may be implemented in vacuum tube assembly 500, and vice versa.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

What is claimed is:

1. A vacuum tube assembly for use in a vacuum cleaner, the vacuum tube assembly comprising:

an outer tube including a first end and a second end distal from the first end, the outer tube defining a vacuum passage extending from the first end to the second end;

an inner tube disposed at least partially within the vacuum passage and connected to the outer tube for telescopic adjustment therewith, the inner tube including a first end and a second end distal from the first end, wherein one of the first end of the outer tube and the second end of the inner tube is configured for connection to a hose of the vacuum cleaner, and the other of the first end of the outer tube and second end of the inner tube is configured for connection to a vacuum cleaner tool;

an adjustment clamp connected to the second end of the outer tube, the adjustment clamp comprising:

a clamp body connected to the second end of the outer tube, the clamp body having an inner diameter; and a lever connected to the clamp body and moveable between a first, latched position and a second, unlatched position to permit selective adjustment of the inner diameter of the clamp body and selective clamping between the adjustment clamp and the inner tube; and an electrical conduit tube assembly including an outer conduit tube and an inner conduit tube, the inner conduit tube connected to the outer conduit tube for telescopic adjustment therewith, wherein the clamp body further includes a conduit tube sleeve defining an opening extending longitudinally through the clamp body, at least a portion of the conduit tube assembly extending through the opening, and wherein the inner conduit tube is fixed relative to the inner tube of the vacuum tube assembly.

2. The vacuum tube assembly of claim 1, wherein the adjustment clamp includes a pivot adapter and an adjustment fastener extending through the clamp body and connected to the pivot adapter, wherein the lever is pivotably connected to the pivot adapter by a pin defining a rotational axis about which the lever rotates when moved between the latched and unlatched positions.

3. The vacuum tube assembly of claim 2, wherein the adjustment fastener is a screw connected to the pivot adapter to permit selective adjustment of a clamping force imparted by the clamp body when the lever is moved from the unlatched position to the latched position.

4. The vacuum tube assembly of claim 3, wherein the clamp body defines a compression slot between a first longitudinal edge and a second longitudinal edge, the first and second longitudinal edges spaced apart from one another and disposed on opposite sides of the compression slot, the adjustment screw extending through the first and second longitudinal edges and connected to the pivot adapter, wherein actuation of the lever causes the pin to pull the first and second longitudinal edges toward each other and causes the clamp body to releasably fix the inner tube relative to the outer tube.

5. The vacuum tube assembly of claim 1, further including at least one seal disposed between the outer tube and the inner tube, wherein the adjustment clamp is fixed to the second end of the outer tube, and wherein the clamp body includes a smooth, contoured outer surface.

6. The vacuum tube assembly of claim 5, wherein the clamp body defines a recessed portion configured to receive the lever therein when the lever is in the latched position such that the lever is conformal with the outer surface.

7. The vacuum tube assembly of claim 1, wherein the clamp body includes a connector portion and a clamping portion, the connector portion connected to the second end of the outer tube, the lever connected to the clamping portion, wherein the clamp body defines a circumferential slot extending at least partially around the clamp body and between the connector portion and the clamping portion.

8. The vacuum tube assembly of claim 7, wherein the clamping portion defines a compression slot between a first longitudinal edge and a second longitudinal edge, the first and second longitudinal edges spaced apart from one another and disposed on opposite sides of the compression slot, wherein actuation of the lever pulls the first and second longitudinal edges toward each other and causes the clamp body to releasably fix the inner tube relative to the outer tube.

9. The vacuum tube assembly of claim 8, wherein the compression slot extends into the circumferential slot defined between the connector portion and the clamping portion, and wherein the connector portion has a fixed inner diameter and the clamping portion has a selectively adjustable inner diameter.

10. A vacuum cleaner comprising:

a vacuum cleaner suction unit; and a vacuum tube assembly connected in fluid communication with the vacuum cleaner suction unit, the vacuum tube assembly comprising:

an outer tube including a first end and a second end distal from the first end, the outer tube defining a vacuum passage extending from the first end to the second end;

an inner tube disposed at least partially within the vacuum passage and connected to the outer tube for telescopic adjustment therewith, the inner tube including a first end and a second end distal from the first end, wherein one of the first end of the outer tube and the second end of the inner tube is configured for connection to a hose of the vacuum cleaner, and the other of the first end of the outer tube and second end of the inner tube is configured for connection to a vacuum cleaner tool;

at least one seal disposed between the outer tube and the inner tube;

an adjustment clamp connected to the second end of the outer tube, the adjustment clamp comprising:

a clamp body connected to the second end of the outer tube, the clamp body having an inner diameter; and a lever operatively connected to the clamp body and moveable between a first, latched position and a second, unlatched position to permit selective adjustment of the inner diameter of the clamp body and selective clamping between the clamp body and the inner tube; and an electrical conduit and an electrical conduit tube assembly defining a conduit passage, the electrical conduit extending through the conduit passage, and wherein the clamp body further includes a conduit tube sleeve defining an opening extending longitudinally through the clamp body, at least a portion of the conduit tube assembly extending through the opening.

11. The vacuum cleaner of claim 10, wherein the adjustment clamp includes a pivot adapter and an adjustment fastener extending through the clamp body and connected to the pivot adapter, wherein the lever is pivotably connected to the pivot adapter by a pin defining a rotational axis about which the lever rotates when moved between the latched and unlatched positions.

12. The vacuum cleaner of claim 11, wherein the adjustment fastener is a screw adapted to permit selective adjustment of a clamping force imparted by the clamp body when the lever is moved from the unlatched position to the latched position.

13. The vacuum cleaner of claim 12, wherein the clamp body defines a compression slot between a first longitudinal edge and a second longitudinal edge, the first and second longitudinal edges spaced apart from one another and disposed on opposite sides of the compression slot, the adjustment screw extending through the first and second longitudinal edges and connected to the pivot adapter, wherein actuation of the lever causes the pin to pull the first and second longitudinal edges toward each other and causes the clamp body to releasably fix the inner tube relative to the outer tube.

14. The vacuum cleaner of claim 10, wherein the clamp body includes a connector portion and a clamping portion, the connector portion connected to the second end of the outer tube, the lever connected to the clamping portion, wherein the clamp body defines a circumferential slot extending at least partially around the clamp body and between the connector portion and the clamping portion.

15. The vacuum cleaner of claim 10 further including a powered floor tool connected to the vacuum tube assembly, the electrical conduit electrically connected to the powered floor tool to supply electrical power thereto.

16. A backpack vacuum cleaner comprising:

a backpack assembly including a vacuum cleaner suction unit; and a vacuum tube assembly connected in fluid communication with the vacuum cleaner suction unit, the vacuum tube assembly comprising:

an outer tube including a first end and a second end distal from the first end, the outer tube defining a vacuum passage extending from the first end to the second end;

an inner tube disposed at least partially within the vacuum passage and connected to the outer tube for telescopic adjustment therewith, the inner tube including a first end and a second end distal from the first end, wherein one of the first end of the outer tube and the second end of the inner tube is configured for connection to a hose of the vacuum cleaner, and the other of the first end of the outer tube and second end of the inner tube is configured for connection to a vacuum cleaner tool; and an adjustment clamp connected to the second end of the outer tube, the adjustment clamp comprising:

a clamp body connected to the second end of the outer tube, the clamp body having an inner diameter; and a lever operatively connected to the clamp body and moveable between a first, latched position and a second, unlatched position to permit selective adjustment of the inner diameter of the clamp body and selective clamping between the clamp body and the inner tube; and an electrical conduit and an electrical conduit tube assembly defining a conduit passage, the electrical conduit extending through the conduit passage, and wherein the clamp body further includes a conduit tube sleeve defining an opening extending longitudinally through the clamp body, at least a portion of the conduit tube assembly extending through the opening.

17. The vacuum cleaner of claim 16, wherein the adjustment clamp includes a pivot adapter and an adjustment screw extending through the clamp body and connected to the pivot adapter, wherein the lever is pivotably connected to the pivot adapter by a pin defining a rotational axis about which the lever rotates when moved between the latched and unlatched positions, and wherein the adjustment screw is adjustably connected to the pivot adapter to permit selective adjustment of a clamping force imparted by the clamp body when the lever is moved from the unlatched position to the latched position.

18. The vacuum cleaner of claim 17, wherein the clamp body defines a compression slot between a first longitudinal edge and a second longitudinal edge, the first and second longitudinal edges spaced apart from one another and disposed on opposite sides of the compression slot, the adjustment screw extending through the first and second longitudinal edges and connected to the pivot adapter, wherein actuation of the lever causes the pin to pull the first and second longitudinal edges toward each other and causes the clamp body to releasably fix the inner tube relative to the outer tube.

19. The backpack vacuum cleaner of claim 18, wherein the backpack assembly includes at least one shoulder strap for securing the backpack assembly to a user's torso.

20. The backpack vacuum cleaner of claim 19, wherein the clamp body includes a connector portion and a clamping portion, the connector portion connected to the second end of the outer tube, the lever connected to the clamping portion, wherein the clamp body defines a circumferential slot extending at least partially around the clamp body and between the connector portion and the clamping portion.

* * * * *